US009485814B2

(12) United States Patent
Valois

(10) Patent No.: US 9,485,814 B2
(45) Date of Patent: Nov. 1, 2016

(54) SYSTEMS AND METHODS FOR A HYSTERESIS BASED DRIVER USING A LED AS A VOLTAGE REFERENCE

(71) Applicant: Charles Valois, Westford, MA (US)

(72) Inventor: Charles Valois, Westford, MA (US)

(73) Assignee: Integrated Illumination Systems, Inc., Morris, CT (US)

( * ) Notice: Subject to any disclaimer, the term of this patent is extended or adjusted under 35 U.S.C. 154(b) by 567 days.

(21) Appl. No.: 13/734,155

(22) Filed: Jan. 4, 2013

(65) Prior Publication Data

US 2014/0191684 A1 Jul. 10, 2014

(51) Int. Cl.
*H05B 37/02* (2006.01)
*H05B 33/08* (2006.01)

(52) U.S. Cl.
CPC ..... *H05B 33/0815* (2013.01); *H05B 33/08* (2013.01); *H05B 37/02* (2013.01)

(58) Field of Classification Search
CPC ..... H05B 33/0815; H05B 33/0818; H05B 33/083; H05B 33/0845; H05B 33/0827; H05B 33/0809; H05B 33/0812; H05B 33/0851; H05B 33/089; H05B 33/08; H05B 37/02
USPC ..... 315/169.1, 247, 291, 294, 297, 307, 315/312, 185 R, 224–225, 308, 360
See application file for complete search history.

(56) References Cited

U.S. PATENT DOCUMENTS 4,139,770 A 2/1979 Beyersdorf
5,264,997 A 11/1993 Hutchisson et al.
5,465,199 A 11/1995 Bray et al.
5,561,346 A 10/1996 Byrne
5,659,582 A 8/1997 Kojima et al.
5,783,909 A 7/1998 Hochstein
5,803,579 A 9/1998 Turnbull et al.
5,909,429 A 6/1999 Satyanarayana et al.
5,947,587 A 9/1999 Keuper et al.
6,013,988 A 1/2000 Bucks et al.
6,016,038 A 1/2000 Mueller et al.
6,040,663 A 3/2000 Bucks et al.

(Continued)

FOREIGN PATENT DOCUMENTS

WO WO-03/017733 A1 2/2003

OTHER PUBLICATIONS

"1-Wire Products Deliver a Powerful Combination . . . ", Mixed-Signal Design Guide, Dallas Semiconductor Maxim, 2005, 7 pages.

(Continued)

*Primary Examiner* — Tung X Le
(74) *Attorney, Agent, or Firm* — Foley & Lardner LLP; Christopher J. McKenna

(57) ABSTRACT

The present disclosure is directed to a hysteresis based driver that incorporates the forward voltage of the LEDs being driven into the design of the driver itself. Instead of providing a typical fixed voltage reference, the forward voltage of one or more LEDS driven by the driver is used as a voltage reference. As the input voltage varies during operation of the one or more LEDs, the current varies as well. This current change is larger than it would be without the LEDs and only resistors. This variable current measurement may be used as input into a hysteresis circuit that controls the switch that turns on and off the one or more LEDs. As such, the driver may not incorporate or use a typical fixed voltage reference such as one provided by a zener diode.

7 Claims, 3 Drawing Sheets

(56) References Cited

U.S. PATENT DOCUMENTS 6,094,014 A 7/2000 Bucks et al.
6,127,783 A 10/2000 Pashley et al.
6,147,458 A 11/2000 Bucks et al.
6,150,774 A 11/2000 Mueller et al.
6,157,093 A 12/2000 Giannopoulos et al.
6,166,496 A 12/2000 Lys et al.
6,194,839 B1 2/2001 Chang
6,201,353 B1 3/2001 Chang et al.
6,211,626 B1 4/2001 Lys et al.
6,234,645 B1 5/2001 Borner et al.
6,234,648 B1 5/2001 Borner et al.
6,236,331 B1 5/2001 Dussureault
6,238,065 B1 5/2001 Jones
6,249,088 B1 6/2001 Chang
6,250,774 B1 6/2001 Begemann et al.
6,253,530 B1 7/2001 Price et al.
6,288,497 B1 9/2001 Chang et al.
6,292,901 B1 9/2001 Lys et al.
6,299,329 B1 10/2001 Mui et al.
6,304,464 B1 10/2001 Jacobs et al.
6,305,818 B1 10/2001 Lebens et al.
6,340,864 B1 1/2002 Wacyk
6,340,868 B1 1/2002 Lys et al.
6,384,545 B1 5/2002 Lau
6,411,046 B1 6/2002 Muthu
6,441,558 B1 8/2002 Muthu et al.
6,443,592 B1 9/2002 Unger et al.
6,445,139 B1 9/2002 Marshall et al.
6,459,919 B1 10/2002 Lys et al.
6,489,731 B1 12/2002 Bruning et al.
6,495,964 B1 12/2002 Muthu et al.
6,507,158 B1 1/2003 Wang
6,507,159 B2 1/2003 Muthu
6,510,995 B2 1/2003 Muthu et al.
6,513,949 B1 2/2003 Marshall et al.
6,528,954 B1 3/2003 Lys et al.
6,552,495 B1 4/2003 Chang
6,576,881 B2 6/2003 Muthu et al.
6,577,080 B2 6/2003 Lys et al.
6,577,512 B2 6/2003 Tripathi et al.
6,580,309 B2 6/2003 Jacobs et al.
6,586,890 B2 7/2003 Min et al.
6,596,977 B2 7/2003 Muthu et al.
6,608,453 B2 8/2003 Morgan et al.
6,609,813 B1 8/2003 Showers et al.
6,617,795 B2 9/2003 Bruning
6,621,235 B2 9/2003 Chang
6,630,801 B2 10/2003 Schuurmans
6,636,003 B2 10/2003 Rahm et al.
6,639,368 B2 10/2003 Sheoghong
6,676,284 B1 1/2004 Wynne Willson
6,692,136 B2 2/2004 Marshall et al.
6,720,745 B2 4/2004 Lys et al.
6,724,159 B2 4/2004 Gutta et al.
6,734,639 B2 5/2004 Chang et al.
6,741,351 B2 5/2004 Marshall et al.
6,762,562 B2 7/2004 Leong
6,777,891 B2 8/2004 Lys et al.
6,788,011 B2 9/2004 Mueller et al.
6,796,680 B1 9/2004 Showers et al.
6,796,686 B2 9/2004 Jacob et al.
6,801,003 B2 10/2004 Schanberger et al.
6,806,659 B1 10/2004 Mueller et al.
6,831,569 B2 12/2004 Wang et al.
6,853,150 B2 2/2005 Clauberg et al.
6,853,151 B2 2/2005 Leong et al.
6,859,644 B2 2/2005 Wang
6,922,022 B2 7/2005 Bucks et al.
6,930,452 B2 8/2005 De Krijger et al.
6,932,477 B2 8/2005 Stanton
6,933,685 B2 8/2005 Gutta et al.
6,933,767 B2 8/2005 Bucks et al.
6,965,205 B2 11/2005 Piepgras et al.
6,969,954 B2 11/2005 Lys
6,972,525 B2 12/2005 Bucks et al.
6,975,079 B2 12/2005 Lys et al.
6,992,803 B2 1/2006 Chang
6,998,594 B2 2/2006 Gaines et al.
7,014,336 B1 3/2006 Ducharme et al.
7,030,572 B2 4/2006 Nijhof et al.
7,031,920 B2 4/2006 Dowling et al.
7,038,398 B1 5/2006 Lys et al.
7,038,399 B2 5/2006 Lys et al.
7,064,498 B2 6/2006 Dowling et al.
7,067,992 B2 6/2006 Leong et al.
7,071,762 B2 7/2006 Xu et al.
7,113,541 B1 9/2006 Lys et al.
7,118,248 B2 10/2006 Wynne Willson
7,132,804 B2 11/2006 Lys et al.
7,135,824 B2 11/2006 Lys et al.
7,139,617 B1 11/2006 Morgan et al.
7,140,752 B2 11/2006 Ashdown
7,161,311 B2 1/2007 Mueller et al.
7,161,313 B2 1/2007 Piepgras et al.
7,161,556 B2 1/2007 Morgan et al.
7,178,941 B2 2/2007 Roberge et al.
7,180,252 B2 2/2007 Lys et al.
7,186,003 B2 3/2007 Dowling et al.
7,202,608 B2 4/2007 Robinson et al.
7,202,613 B2 4/2007 Morgan et al.
7,202,641 B2 4/2007 Claessens et al.
7,204,622 B2 4/2007 Dowling et al.
7,221,104 B2 5/2007 Lys et al.
7,228,190 B2 6/2007 Dowling et al.
7,231,060 B2 6/2007 Dowling et al.
7,233,115 B2 6/2007 Lys
7,233,831 B2 6/2007 Blackwell
7,242,152 B2 7/2007 Dowling et al.
7,253,566 B2 8/2007 Lys et al.
7,255,457 B2 8/2007 Ducharme et al.
7,255,458 B2 8/2007 Ashdown
7,256,554 B2 8/2007 Lys
7,262,559 B2 8/2007 Tripathi et al.
7,267,461 B2 9/2007 Kan et al.
7,274,160 B2 9/2007 Mueller et al.
7,300,192 B2 11/2007 Mueller et al.
7,308,296 B2 12/2007 Lys et al.
7,309,965 B2 12/2007 Dowling et al.
7,314,289 B2 1/2008 Montagne
7,319,298 B2 1/2008 Jungwirth et al.
7,323,676 B2 1/2008 Duijve
7,329,998 B2 2/2008 Jungwirth
7,350,936 B2 4/2008 Ducharme et al.
7,352,138 B2 4/2008 Lys et al.
7,352,339 B2 4/2008 Morgan et al.
7,353,071 B2 4/2008 Blackwell et al.
7,354,172 B2 4/2008 Chemel et al.
7,358,679 B2 4/2008 Lys et al.
7,358,681 B2 4/2008 Robinson et al.
7,358,706 B2 4/2008 Lys
7,358,929 B2 4/2008 Mueller et al.
7,358,961 B2 4/2008 Zwanenburg
7,387,405 B2 6/2008 Ducharme et al.
7,388,665 B2 6/2008 Ashdown
7,394,210 B2 7/2008 Ashdown
7,420,335 B2 9/2008 Robinson et al.
7,423,387 B2 9/2008 Robinson et al.
7,432,668 B2 10/2008 Zwanenburg et al.
7,443,209 B2 10/2008 Chang
7,449,847 B2 11/2008 Schanberger et al.
7,453,217 B2 11/2008 Lys et al.
7,459,864 B2 12/2008 Lys
7,462,997 B2 12/2008 Mueller et al.
7,463,070 B2 12/2008 Wessels
7,482,565 B2 1/2009 Morgan et al.
7,482,760 B2 1/2009 Jungwirth et al.
7,490,953 B2 2/2009 Holten et al.
7,490,957 B2 2/2009 Leong et al.
7,495,671 B2 2/2009 Chemel et al.
7,502,034 B2 3/2009 Chemel et al.
7,505,395 B2 3/2009 Ashdown et al.
7,507,001 B2 3/2009 Kit
7,511,436 B2 3/2009 Xu
7,511,437 B2 3/2009 Lys et al.

(56) References Cited

U.S. PATENT DOCUMENTS 7,515,128 B2 4/2009 Dowling
7,520,634 B2 4/2009 Ducharme et al.
7,521,872 B2 4/2009 Bruning
7,525,254 B2 4/2009 Lys et al.
7,538,499 B2 5/2009 Ashdown
7,542,257 B2 6/2009 McCormick et al.
7,550,931 B2 6/2009 Lys et al.
7,550,935 B2 6/2009 Lys et al.
7,557,521 B2 7/2009 Lys
7,569,807 B2 8/2009 Matheson
7,572,028 B2 8/2009 Mueller et al.
7,573,209 B2 8/2009 Ashdown et al.
7,573,210 B2 8/2009 Ashdown et al.
7,573,729 B2 8/2009 Elferich et al.
7,598,681 B2 10/2009 Lys et al.
7,598,684 B2 10/2009 Lys et al.
7,598,686 B2 10/2009 Lys et al.
7,619,370 B2 11/2009 Chemel et al.
7,652,236 B2 1/2010 Cortenraad et al.
7,654,703 B2 2/2010 Kan et al.
7,656,366 B2 2/2010 Ashdown
7,658,506 B2 2/2010 Dowling
7,659,673 B2 2/2010 Lys
7,659,674 B2 2/2010 Mueller et al.
7,665,883 B2 2/2010 Matheson
7,667,409 B2 2/2010 Geerts et al.
7,675,238 B2 3/2010 Cortenraad et al.
7,687,753 B2 3/2010 Ashdown
7,688,002 B2 3/2010 Ashdown et al.
7,689,130 B2 3/2010 Ashdown
7,703,951 B2 4/2010 Piepgras et al.
7,710,369 B2 5/2010 Dowling
7,712,926 B2 5/2010 Matheson
7,714,521 B2 5/2010 Qian
7,731,387 B2 6/2010 Cortenraad et al.
7,731,389 B2 6/2010 Draganov et al.
7,731,390 B2 6/2010 Van Gorkom et al.
7,737,643 B2 6/2010 Lys
7,738,002 B2 6/2010 Ashdown et al.
7,740,375 B2 6/2010 Zou et al.
7,766,489 B2 8/2010 Duine et al.
7,766,518 B2 8/2010 Piepgras et al.
7,772,787 B2 8/2010 Ashdown et al.
7,777,427 B2 8/2010 Stalker, III
7,781,979 B2 8/2010 Lys
7,802,902 B2 9/2010 Moss et al.
7,806,558 B2 10/2010 Williamson
7,808,191 B2 10/2010 Wu
7,809,448 B2 10/2010 Lys et al.
7,810,974 B2 10/2010 Van Rijswick et al.
7,845,823 B2 12/2010 Mueller et al.
7,850,347 B2 12/2010 Speier et al.
7,854,539 B2 12/2010 Van Duijneveldt
7,868,562 B2 1/2011 Salsbury et al.
7,878,683 B2 2/2011 Logan et al.
7,878,688 B2 2/2011 Paulussen et al.
7,893,631 B2 2/2011 Speier
7,893,661 B2 2/2011 Ackermann et al.
7,894,050 B2 2/2011 Ashdown et al.
7,906,917 B2 3/2011 Tripathi et al.
7,911,151 B2 3/2011 Xu
7,914,173 B2 3/2011 Paulussen et al.
8,022,632 B2 9/2011 Schulz et al.
8,026,673 B2 9/2011 Lys
8,659,239 B2 * 2/2014 Liao et al. ..... 315/307
8,692,482 B2 * 4/2014 Szczeszynski ..... H05B 33/0815 315/209 R
2002/0074559 A1 6/2002 Dowling et al.
2002/0158590 A1 * 10/2002 Saito ..... H05B 33/0809 315/291
2003/0132721 A1 7/2003 Jacobs et al.
2003/0133292 A1 7/2003 Mueller et al.
2004/0052076 A1 3/2004 Mueller et al.
2004/0090191 A1 5/2004 Mueller et al.
2004/0178751 A1 9/2004 Mueller et al.
2004/0251854 A1 * 12/2004 Matsuda ..... H05B 33/0815 315/291
2005/0236998 A1 10/2005 Mueller et al.
2005/0275626 A1 12/2005 Mueller et al.
2006/0002110 A1 1/2006 Dowling et al.
2006/0076908 A1 4/2006 Morgan et al.
2006/0114201 A1 6/2006 Chang
2006/0152172 A9 7/2006 Mueller et al.
2006/0221606 A1 10/2006 Dowling
2006/0262521 A1 11/2006 Piepgras et al.
2006/0274526 A1 12/2006 Weston et al.
2006/0290624 A1 12/2006 Ashdown
2007/0063658 A1 3/2007 Van Der Veeken
2007/0086912 A1 4/2007 Dowling et al.
2007/0115658 A1 5/2007 Mueller et al.
2007/0145915 A1 6/2007 Roberge et al.
2007/0153514 A1 7/2007 Dowling et al.
2007/0230159 A1 10/2007 Cortenraad et al.
2007/0236159 A1 * 10/2007 Beland ..... 315/312
2007/0258240 A1 11/2007 Ducharme et al.
2007/0273290 A1 11/2007 Ashdown et al.
2008/0042599 A1 2/2008 Ashdown
2008/0043464 A1 2/2008 Ashdown
2008/0048582 A1 2/2008 Robinson
2008/0062413 A1 3/2008 Ashdown et al.
2008/0089060 A1 4/2008 Kondo et al.
2008/0094005 A1 4/2008 Rabiner et al.
2008/0122386 A1 5/2008 De Brouwer et al.
2008/0136331 A1 6/2008 Schmeikal
2008/0136796 A1 6/2008 Dowling
2008/0140231 A1 6/2008 Blackwell et al.
2008/0164826 A1 7/2008 Lys
2008/0164854 A1 7/2008 Lys
2008/0167734 A1 7/2008 Robinson et al.
2008/0183081 A1 7/2008 Lys et al.
2008/0239675 A1 10/2008 Speier
2008/0265797 A1 10/2008 Van Doorn
2008/0278092 A1 11/2008 Lys et al.
2008/0278941 A1 11/2008 Logan et al.
2008/0290251 A1 11/2008 Deurenberg et al.
2008/0297066 A1 12/2008 Meijer et al.
2008/0298330 A1 12/2008 Leitch
2008/0315798 A1 12/2008 Diederiks et al.
2009/0002981 A1 1/2009 Knibbe
2009/0021175 A1 1/2009 Wendt et al.
2009/0021182 A1 * 1/2009 Sauerlaender ..... H05B 33/0851 315/291
2009/0066264 A1 * 3/2009 Huang ..... H05B 33/0818 315/294
2009/0072761 A1 3/2009 Wessels
2009/0128059 A1 5/2009 Joosen et al.
2009/0134817 A1 5/2009 Jurngwirth et al.
2009/0160364 A1 6/2009 Ackermann et al.
2009/0168415 A1 7/2009 Franciscus Deurenberg et al.
2009/0179587 A1 7/2009 Van Der Veen et al.
2009/0179596 A1 7/2009 Willaert et al.
2009/0189448 A1 7/2009 Verschueren
2009/0224695 A1 9/2009 Van Erp et al.
2009/0230884 A1 9/2009 Van Doorn
2009/0243507 A1 10/2009 Lucero-Vera et al.
2009/0251068 A1 * 10/2009 Holec et al. ..... 315/294
2009/0278473 A1 11/2009 Van Erp
2009/0284174 A1 11/2009 Sauerlander et al.
2009/0289724 A1 * 11/2009 Hu et al. ..... 331/16
2009/0321666 A1 12/2009 Hilgers
2010/0007600 A1 1/2010 Deurenberg et al.
2010/0026191 A1 2/2010 Radermacher et al.
2010/0045478 A1 2/2010 Schulz et al.
2010/0072901 A1 3/2010 De Rijck et al.
2010/0072902 A1 3/2010 Wendt et al.
2010/0079085 A1 4/2010 Wendt et al.
2010/0079091 A1 4/2010 Deixler et al.
2010/0084995 A1 4/2010 Baaijens et al.
2010/0091488 A1 4/2010 Ijzerman et al.
2010/0094439 A1 4/2010 Van De Meulenhof et al.
2010/0102732 A1 4/2010 Peeters et al.
2010/0117543 A1 5/2010 Van Der Veen et al.
2010/0117656 A1 5/2010 Snelten
2010/0118531 A1 5/2010 Montagne

(56) References Cited

U.S. PATENT DOCUMENTS

| | | | | |
|---|---|---|---|---|
| 2010/0127633 | A1 | 5/2010 | Geerts et al. | |
| 2010/0134041 | A1 | 6/2010 | Radermacher et al. | |
| 2010/0134042 | A1 | 6/2010 | Willaert | |
| 2010/0148689 | A1 | 6/2010 | Morgan et al. | |
| 2010/0164399 | A1 | 7/2010 | Radermacher et al. | |
| 2010/0165618 | A1 | 7/2010 | Vissenberg et al. | |
| 2010/0171771 | A1 | 7/2010 | Otte et al. | |
| 2010/0181936 | A1 | 7/2010 | Radermacher et al. | |
| 2010/0188007 | A1 | 7/2010 | Deppe et al. | |
| 2010/0194293 | A1 | 8/2010 | Deurenberg et al. | |
| 2010/0231133 | A1 | 9/2010 | Lys | |
| 2010/0231363 | A1 | 9/2010 | Knibbe | |
| 2010/0244707 | A1 | 9/2010 | Gaines et al. | |
| 2010/0244734 | A1 | 9/2010 | Van Herpen et al. | |
| 2010/0259182 | A1 | 10/2010 | Man et al. | |
| 2010/0264834 | A1 | 10/2010 | Gaines et al. | |
| 2010/0271843 | A1 | 10/2010 | Holten et al. | |
| 2010/0289532 | A1 | 11/2010 | Wendt et al. | |
| 2010/0301780 | A1 | 12/2010 | Vinkenvleugel | |
| 2010/0308745 | A1 | 12/2010 | Delnoij | |
| 2011/0025205 | A1 | 2/2011 | Van Rijswick et al. | |
| 2011/0025230 | A1 | 2/2011 | Schulz et al. | |
| 2011/0035404 | A1 | 2/2011 | Morgan et al. | |
| 2011/0042554 | A1 | 2/2011 | Hilgers et al. | |
| 2011/0090684 | A1 | 4/2011 | Logan et al. | |
| 2011/0095694 | A1 | 4/2011 | Justel et al. | |
| 2011/0285292 | A1 | 11/2011 | Mollnow et al. | |
| 2011/0291812 | A1 | 12/2011 | Verbrugh | |
| 2012/0019670 | A1 | 1/2012 | Chang et al. | |
| 2012/0326618 | A1* | 12/2012 | Kim | H05B 33/0851 315/224 |
| 2013/0009557 | A1* | 1/2013 | Szczeszynski | 315/186 |

OTHER PUBLICATIONS

"Conductivity with the BS2/OWL2", EME Systems, 2002, pp. 1-3.
"Dimmable Fluorescent Ballast", ATAVRFBKIT/EVLB001, User Guide, ATMEL, 2007, 35 pages.
"Understanding Boost Power Stages in Switchmode Power Supplies", Application Report, Texas Instruments, Mixed Signal Products, Mar. 1999, 32 pages.
"Understanding Buck Power Stages in Switchmode Power Supplies", Application Report, Texas Instruments, Mixed Signal Products, Mar. 1999, 36 pages.
Barberis, C. "Precision current sink costs less than $20", EDN Design Ideas, 43(6), 1998, 2 pages.
Bellcomb Technologies Incorporated, "Edges, Joiners, Attachments", Web Address: http://www.bellcomb.com/caps/edges.htm, Apr. 22, 2007, pp. 1-3.
Bookmarks Menu—Controllers/Wireless—Deisgn Ideas, dated Dec. 6, 2012, 1 pg.
Bowling, S. "Buck-Boost LED Driver Using the PIC16F785 MCU", Microchip, AN1047, 2006, pp. 1-12.
By Staff, Dali Delivers Control and Cost Savings, Headaches Too, Consulting-Specifying Engineer, Jun. 2002, 2 pages.
Canny, D. "Controlling slew times tames EMI in offline supplies", EDN Design Ideas, Nov. 14, 2002.
Control Freak Addict Data Sheet, Copyright 2008, Creative Lighting, 5 pages.
Curtis, K. "High Power IR LED Driver Using the PIC16C781/782", Microchip, TB062, 2002, pp. 18.
CybroTech, Managing Lights with Dali, TN-012, rev 2, Cybrotech Ltd., 2007, 11 pgs.
Cypress Perform, Implementing an Integrated DMX512 Receiver, Item ID: 39762, Dec., 16 2009, 1 pg.
Cypress Semiconductor Corporation, PowerPSoC (R) Intelligent LED Driver, Document No: 001-46319, Rev. *G, 2009, 52 pages.
Dali-AG website, Dali at work, 1 pg., last update Apr. 8, 2010.
Davidovic, et al., Lead-Acid Battery Charger Becomes a Subfuction in a Microcontroller, The Authority on Emerging Technologies for Design Solutions, Mar. 2007, 2 pages.
Davmark Ltd., Dali-Protocol, 2007, 6 pages.
Di Jasio, "A Technique to Increase the Frequency Resolution of PICmicro MCU PWM Modules", Microchip, AN1050, 2006, pp. 1-10.
Dietz, et al. "Very Low-Cost Sensing and Communication Using Bidirectional LEDs", Mitsubishi Electric Research Laboratories, Jul. 2003, 19 pgs.
Distler, T. "LED Effects Stream TM v2.0 Protocol (Revision C)", Jun. 2, 2005, pp. 1-5.
Dunn, J. "Matching MOSFET Drivers to MOSEFTs", Microchip, AN799, 2004, pp. 1-10.
Fosler, R. "The RS-232/DALI Bridge Interface", Microchip, AN811, 2002, pp. 1-8.
Fosler, R. "Use a microcontroller to design a boost converter", EDN design ideas, Mar. 4, 2004, pp. 74-75.
Fosler, R., et al. "Digitally Addressable DALI Dimming Ballast", Microchip, AN809, 2002, pp. 118.
Ghulyani, L. "Simple MPPT-Based Lead Acid Charger Using bq2031", Texas Instruments, Dec. 2009, pp. 1-5.
Goder, D. "Scheme provides high-side current sensing for white-LED drivers", EDN, 1 page, Feb. 19, 2004.
Google Search Results for dali query group, search completed on Apr. 8, 2010, accessed at google.com, http://www.google.com/search?hl=en&c1ient=firefox-a&rls=org.mozilla:en-, 2 pages.
Hardwick, M. "DC power wire also carries clock or data", EDN Design Ideas, Mar. 13, 1998.
Hexcel Composites, "Sandwich Panel Fabrication Technology", Web Address: http://www.hexcel.com/NR/rdonlyres/B4574C2C-0644-43AC-96E2-CC15967A4b)5/4547 Sandwich Fabrication.pdf, Jan. 1997, pp. 1-16.
High-Side Current Monitor, ZETEX, Apr. 2001, ZXCT1009, Issue 3, pp. 1-8.
Implementing Infrared Object Detection, http://web.archive.org/web/20080528042614rejwww.seattlerobotics.org/guide/infrared.html, original publication date known, retrieved Apr. 7, 2010, seattlerobotics.org, 4 pages.
Jackson, S. "Circuit protects bus from 5V swings", EDN Design Ideas, Nov. 14, 2002, pp. 102.
Klepin, K. "Temperature Compensation for High Brightness LEDs using EZ-Color (TM) and PSoC Express", Cypress Perform, AN14406, Aug. 10, 2007, pp. 1-4.
Kremin, V. et al. "Multichannel LED Dimmer with CapSense Control—AN13943", Cypress Perform, Jul. 20, 2007, 5 pages.
Kropf, B. "Firmware—RGB Color Mixing Firmware for EZ-Color (TM)—AN16035", Cypress Perform, Jun. 13, 2007, pp. 1-7.
Lager, A. "Use a 555 timer as a switch-mode power supply", EDN Design Ideas, Nov. 14, 2002, 1 page.
Lee, M. Shunt Battery Charger Provides 1A Continuous Current, EDN Magazine, 1997.
Locher, R. "Introduction to Power MOSEFETs and their Applications", Fairchild Semiconductor (TM), Application Note 558, Rev B, Oct. 1998, 15 pgs.
McArthur, R., "Making Use of Gate Charge to Design the Gate Drive Circuit for Power MOSEFETs and IGBTs data sheets", International Rectifier, Application Note AN-944, Advanced Power Technology, 5 pgs., 2001.
Miller, R. "Digital addressable lighting interface protocol fosters systems interoperability for lower costs and greater design flexibility", RNM Engineering, Inc., Apr. 2003, pp. 1-20.
Nell, S. "VCO uses programmable logic", EDN Design Ideas, Nov. 14, 2002.
News & Events DALI Digital addressable lighting interface lamp luminaire control, accessed at http://www.dali-ag.org/ on Apr. 8, 2010, original publication date unknown, updated Apr. 8, 2010, 1 pg.
O'Loughlin, M. "350-W, Two-Phase Interleaved PFC Pre-regulator Design Review", Texas Instruments, Application Report, Revised Mar. 2007, 21 pages.
O'Loughlin, M., PFC Pre-Regulator Frequency Dithering Circuit, Texas Instruments, May 2007, pp. 1-8.
Perrin, R. Inexpensive Relays Form Digital Potentiometer, EDN Design Ideas, 1998, 2 pages.

(56) References Cited

OTHER PUBLICATIONS

Petersen, A. "Harness solar power with smart power-conversion techniques", EDN, Green Electronics designfeature, Feb. 4, 1999, pp. 119-124.
Prendergast, P. "How to Design a Three-Channel LED Driver", Cypress Perform, Jan. 2008, pp. 1-9.
Renesas, R8C/25 Demonstration Example for DALI Lighting Protocol Stack, REU05B0077-0100/Rev. 1.00, Jul. 2008, 14 pgs.
Richardson, C., Matching Driver to LED, National Semiconductor, Jan. 2008, 5 pgs.
Richardson. C., LM3404 Driving a Seoul Semi Zpower P4 1A LED-RD-I34, National Semiconductor, Apr. 2007, 6 pages.
Shanmugam, S. "Design of a linear Fresnel lens system for solar photovoltaic electrical power source", Proc. SPIE 4572, Intelligent Robots and Computer Vision XX: Algorithms, Techniques, and Active Vision, 556, Oct. 5, 2001, 8 pages.
Shill, M. "Simple logic probe uses bicolor LED", EDN Design Ideas, Mar. 13, 1998, 2 pages.
Software Design Specification, Z-Wave Protocol Overview, Z wave the wireless language, Zensys A/S, May 9, 2007, 20 pages.
Soundlight, Operating Manual, DALI and DMX Dekoder 7064A-H Mk1, 2008, 8 pgs.
Takahashi A., Methods and Features of LED Drivers, National Semiconductor, Mar. 2008, 3 pgs.
Universal Powerline Bus Communication Technology, Overview, PCS Powerline Control Systems UPB (Universal Powerline Bus), Jan. 8, 2002, pp. 1-13.
UPB Technology Description, PCS—Powerline Control Systems, UPB (Universal Powerline Bus), Version 1.4, Apr. 16, 2007, 68 pages.
Van Dorsten, Arian, A Low Cost Step-up Converter by IC 555, posted Jul. 21, 2007, http://www.eleccircuit.comla-low-cost-step-up-converter-by-ic-5551, retrieved Apr. 7, 2010, 2 pages.
Walma, K., Dali: Forerunner of Today's Breakthrough Lighting Technology, Feb. 2007, 2 pages.
Wikipedia, Digital Addressable Lighting Interface, original publication date unknown, Retrieved from:Retrieved from "http://en.wikipedia.org/wikiJDigital_Addressable_Lighting_interface" accessed on Apr. 8, 2010, 3 pages.
Witt, J. "Switched-capacitor regulator provides gain", EDN Design Ideas, Mar. 13, 1998, 2 pages.
Wojslaw, C. "DPP adds versatility to VFC", EDN, design ideas, Nov. 14, 2002, 1 page.
Young, R. "Power circuit terminates DDR DRAMs", EDN Design Ideas, Nov. 14, 2002, 1 page.
Zarr, R. Driving High-Power LEDs, Machine Design, Oct. 2007, 3 pages.
Zensys ASCII Interface, VIZIA, 2007, 12 pages.
Z-Wave Vizia Etc thread, retrieved at http://groups.google.com/group/comp.home.automation/browse_thread/thread/449c2c66934dfSfb/fSl12116a8231aa1?Ink=st&q=z-wave&rnum=98#fSl12116a8231aa1, www.ztech.com, 18 pages, 2007.

* cited by examiner

SYSTEMS AND METHODS FOR A HYSTERESIS BASED DRIVER USING A LED AS A VOLTAGE REFERENCE

FIELD OF THE INVENTION

The present application is generally related to lighting systems. In particular, the present application is directed to systems and methods for providing a hysteresis based driver that incorporates the forward voltage of a light emitting device (LED).

BACKGROUND

Lighting systems may include light emitting devices organized in various configurations depending on the illumination applications. The LEDs are semiconductor devices that have a forward voltage. Different LEDs may have different forward voltages which may further vary based on operation of the LED. As LEDs heat up, the forward voltage drops and the current passing through the LED increases. For a given temperature, a small change in forward voltage can product a disproportionally large change in forward current. Also, the forward voltage required to achieve a desired light output can vary with LED die size, die materials, lot variations and temperature. In a circuit with LEDs and without regulation, the current will increase with an increase in supply voltage and/or a decrease in LED forward voltage, and, conversely, will decrease with a decrease in supply voltage and/or an increase in LED forward voltage.

SUMMARY

The present disclosure is directed to a hysteresis based driver that incorporates the forward voltage of the LEDs being driven into the design of the driver itself. Instead of providing a typical fixed voltage reference, the forward voltage of one or more LEDS driven by the driver is used as a voltage reference. Using the LED voltage as a voltage reference may provide a stable voltage reference. Although the forward voltage of the LEDs is varying, relative to the widely varying supply voltage, the forward voltage of the LEDs can be considered stable. As the input voltage varies during operation of the one or more LEDs, the current varies as well. This current change is larger than it would be without the LEDs and only resistors. This variable current measurement may be used as input into a hysteresis circuit that controls the switch that turns on and off the one or more LEDs. As such, the driver may not incorporate or use a typical fixed voltage reference such as one provided by a zener diode.

The design and construction of this hysteresis based driver provides a variety of advantages. As the variability of the forward voltage Vfa-n of the light sources changes less dramatically or smaller than the corresponding changes in the input voltage, this provides a variable but stable input into the hysteresis based determinations that drive the frequency of switching off and on the switch. With the continuous variability of the reference signal, the driver provides an automatic frequency spectrum in which the frequency of operation automatically changes and without setting a frequency. This also provides a signal to the light sources that comprises a variable frequency during on time with a constant off time. As a result, there is randomization to the current drawn by the light sources.

In some aspects, the present solution is directed to a driver for one or more light emitting diodes (LEDs) that incorporates forward voltage of the one or more LEDs to provide hysteresis. The driver may include a first input to receive an input voltage and a switch electrically coupled to the first input and electrically coupled to one or more light emitting diodes (LEDs). An output of the switch, when switched on, to provide voltage to the one or more LEDs. The driver may include a current measurement component electrically coupled to the one or more LEDS to measure current through the one or more LEDs based on forward voltage of the one or more LEDs. The driver may include a hysteresis component to receive as input the input voltage and a measurement of voltage based on the current measured by the current measurement component. The current measurement component is configured to measure changes to the current based on changes to the forward voltage of the one or more LED. The hysteresis component is electrically coupled to the switch to turn the switch off and on responsive to changes to the input voltage in conjunction with the changes to the forward voltage of the one or more LEDs, as measured by the current measurement component, being above or below a threshold.

In some embodiments, the driver comprises a ballast resistor electrically coupled to an output of the switch. The ballast resistor comprising a predetermined resistance to provide a current, when the switch is on, to the one or more LEDs below the maximum rating of the one or more LEDs. In some embodiments, the hysteresis component comprises a comparator that compares the input voltage to the measurement of voltage based on the current measured by the current measurement component. In some embodiments, the hysteresis component further comprises a feed forward resistor electrically coupled between input and output of the comparator. The feed forward resistor comprises a predetermined resistance that provides a smaller effect than the input voltage to the comparator and a larger effect than an offset voltage of the comparator. In some embodiments, the driver comprises a filter electrically coupled between the current measurement component and the hysteresis component to provide a filtered version of the current measurement from the current measurement component as input to the hysteresis component. The filter is configured to have a predetermined oscillation frequency to avoid exceeding a threshold of the switch. In some embodiments, the current measurement component includes a current sense resistor to convert into voltage the measurement of current through the one or more LEDs. In some embodiments, the current to the one or more LEDs is regulated as the voltage output from the one or more LEDs changes with a lesser effect than changes to the input voltage.

In some aspects, the present solution is directed to a driver for one or more light emitting diodes (LEDs) that uses forward voltage of the one or more LEDs as a reference voltage. The driver includes a first input to receive an input voltage and a switch electrically coupled to the first input and electrically coupled to one or more light emitting diodes (LEDs). An output of the switch, when switched on, to provide voltage to the one or more LEDs. The driver also includes a measurement component electrically coupled to the one or more LEDs to measure current through one or more LEDs based on changes to the input voltage. The driver includes a comparator to receive as a reference voltage a measurement of voltage from the measurement component, the comparator configured to compare the reference voltage to the input voltage. The comparator is electrically coupled to the switch to turn the switch off and on responsive to comparison of the input voltage to the reference voltage comprising forward voltage of the one or more LEDs.

In some embodiments, the driver comprises a ballast resistor electrically coupled to an output of the switch. The ballast resistor has a predetermined resistance to provide a current, when the switch is on, to the one or more LEDs below the maximum rating of the one or more LEDs. In some embodiments, the driver included a feed forward resistor electrically coupled between input and output of the comparator. The feed forward resistor has a predetermined resistance that provides a smaller effect than the input voltage to the comparator and a larger effect than an offset voltage of the comparator. In some embodiments, the driver included a filter electrically coupled between the measurement component and the comparator to provide a filtered version of the current measurement from the measurement component as input to the comparator. The filter may be configured to have a predetermined oscillation frequency to avoid exceeding a threshold of the switch. In some embodiments, the measurement component includes a current sense resistor to convert into voltage the measurement of current through the one or more LEDs. The changes to the forward voltage of the one or more LEDs provides a stable reference voltage to the comparator. In some embodiments, the driver does not have a reference voltage for the comparator other than a stable reference voltage provided by changes to the current through the one or more LEDs.

In some aspects, the present solution is directed to a driver for one or more light emitting diodes (LEDs) that automatically provides varying frequency. The driver includes a first input to receive an input voltage and a switch electrically coupled to the first input and electrically coupled to one or more light emitting diodes (LEDs). An output of the switch, when switched on, to provide voltage to the one or more LEDs. The driver includes a measurement component electrically coupled to the one or more LEDs, to measure voltage across the one or more LEDs based on changes in forward voltage of the one or more LEDs. The driver includes a hysteresis component to receive as input the input voltage and a measurement of voltage responsive to the current measurement component. The measurement component is configured to measure voltage output from the one or more LEDs responsive to changes to the input voltage. The hysteresis component is electrically coupled to the switch to turn the switch off and on responsive to the changes to the voltage output, the voltage output to increase with a larger effect than changes to the input voltage. The driver is configured to have times the switch is on vary based on changes to the input voltage.

In some embodiments, the hysteresis component comprises a comparator and a feed forward resistor electrically coupled between input and output of the comparator, the feed forward resistor comprising a predetermined resistance that provides a smaller effect than the input voltage to the comparator and a larger effect than an offset voltage of the comparator. In some embodiments, the driver includes a filter electrically coupled between the measurement component and the hysteresis component to provide a filtered version of the current measurement from the measurement component as input to the hysteresis component. The filter may be configured to have a predetermined oscillation frequency to avoid exceeding a threshold of the switch. During a charging part of oscillation the filter reacts more quickly as the input voltage increases and the oscillation varies inversely with input voltage. In some embodiments, the measurement component includes a current sense resistor to convert into voltage the measurement of current through the one or more LEDs.

BRIEF DESCRIPTION OF THE DRAWINGS

The foregoing and other objects, aspects, features, and advantages of the present invention will become more apparent and better understood by referring to the following description taken in conjunction with the accompanying drawings, in which.

The features and advantages of the present invention will become more apparent from the detailed description set forth below when taken in conjunction with the drawings, in which like reference characters identify corresponding elements throughout.

DETAILED DESCRIPTION

Figure 1A:
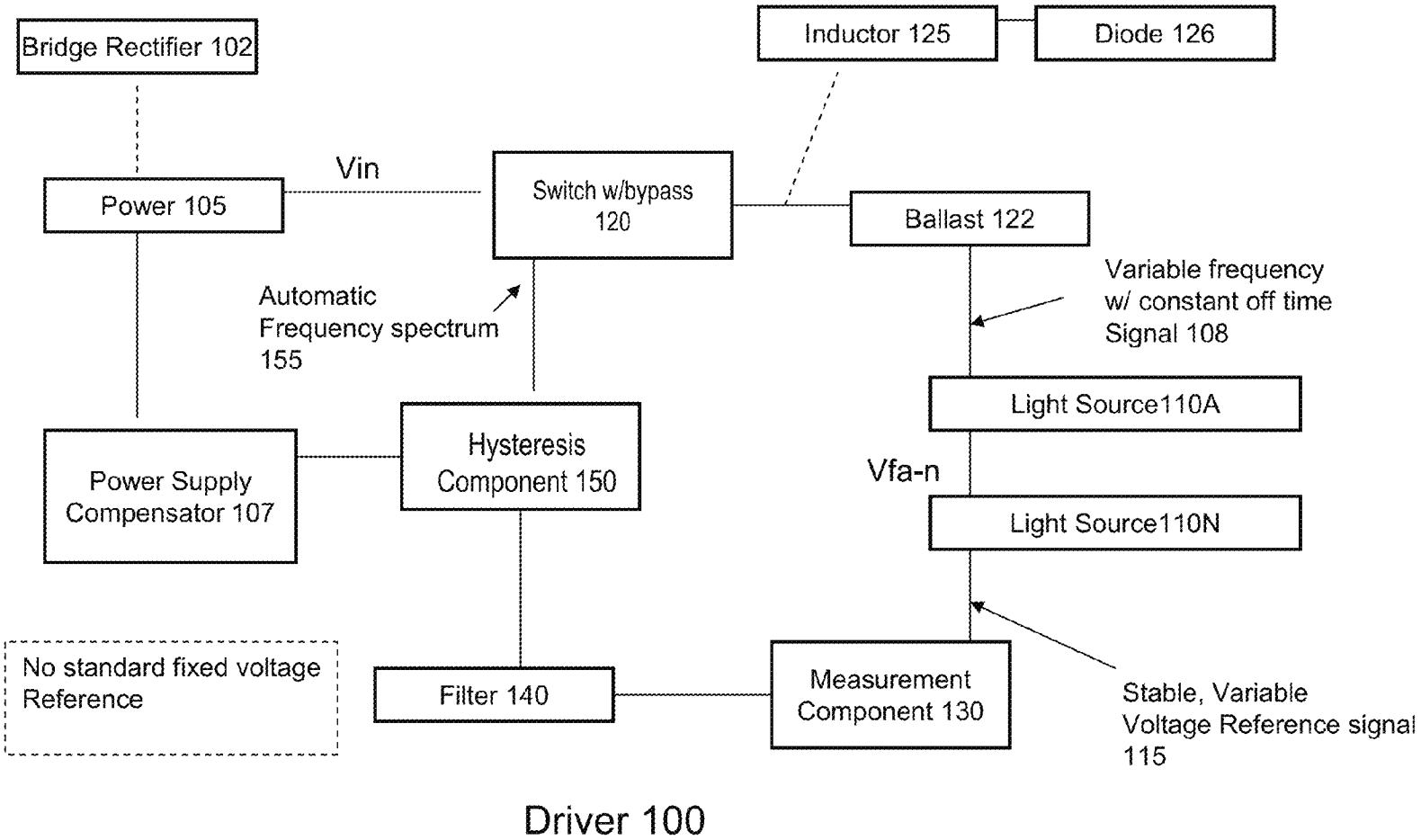
FIG. 1A is a block diagram that depicts an embodiment of a driver.

Referring now to FIG. 1A, a block diagram of a driver 100 of the present solution is depicted. In brief overview, the driver 100 is driven by, connected to or comprises a power source 105 that provides a voltage input, Vin, to a switch with a bypass 120. In some embodiments, the power may be provided via a bridge rectifier 102 that converts an AC input to a DC output. The switch 120 is electrically coupled to one or more lights sources 110A-110N via a ballast circuit 122, such as a ballast resistor. In some embodiments, an inductor 125 and diode 126 may be electrically coupled serially between the switch and the light sources in place of or in addition to the ballast 122 to add a storage component to emphasize or filter certain frequencies. The light sources, such as LEDs, produce a forward voltage Vfa-n. The measurement component 130 may be electrically coupled to the one or more light sources to measure the forward voltage, such as via current passing through the one or more light sources. The measurement component may be electrically coupled to a filter 140 to provide a filtered version of this measurement to a hysteresis component 150. The hysteresis component takes as input a version of the Vin of the power supply via a power supply compensator 107 and the filtered version of the measurement. Based on a comparison of these inputs, the hysteresis component drives the switch on and off, which in turn turns the light sources on and off. The frequency of the switch is driven by the hysteresis component and the variability of the voltage reference signal 115.

The design and construction of this hysteresis based driver provides a variety of advantages. Instead of dealing with the challenges of changes to forward voltages of light sources, such as LEDs, the driver incorporates and leverages the forward voltage into the design and operation of the driver. The driver uses the forward voltage from the light sources as a variable voltage reference signal 115 and thus does not need to use a fixed voltage reference signal such as a zener diode typical to most applications. As the variability of the forward voltage Vfa-n of the light sources changes less dramatically or is smaller than the corresponding changes in the input voltage, this provides a variable yet stable input into the hysteresis based determinations that drive the frequency of switching off and on the switch. With the continuous variability of the reference signal, the driver provides an automatic frequency spectrum 155 in which the frequency of operation automatically changes and without setting a frequency. This also provides a signal 108 to the light sources that comprises a variable frequency during on time with a constant off time. As a result, there is randomization to the current drawn by the light sources.

The driver may include, be electrically coupled to or drive one or more light sources 110A-N connected to each other. In some embodiments, light source is any type and form of semiconductor or device that produces or emits a light. In some embodiments, light source 110 is a semiconductor light emitting device emitting light of any spectral or wavelength range. In some embodiments, light source is a LED. In some embodiments, light source 110 is an OLED, PHOLED, QDLED, or any other variation of a light source 110 utilizing an organic material. In some embodiments, each light source has the same forward voltage (Vf) or Vf profile. In some embodiments, each light source has a different forward voltage (Vf) or different Vf profile. A Vf profile may identify the change and/or rate of change to the Vf of a light source responsive to changes in operating conditions, such as input voltage, current and/or temperature.

In other embodiments, a light source 110 is a fluorescent light. In a number of embodiments, light source 110 is a lamp or a light bulb. In many embodiments, light source is a white light emitting diode. In a plurality of embodiments, the light source 110 is a broadband lamp or a broadband light source. In number of embodiments, the light source 110 is a black light. In a plurality of embodiments, light source 110 is a hollow cathode lamp. In a number of embodiments, light source 110 is a fluorescent tube light source. In some embodiments, the light source 110 is a neon or argon lamp. In a plurality of embodiments, light source 110 is a plasma lamp. In certain embodiments, light source 110 is a xenon flash lamp. In a plurality of embodiments, light source 110 is a mercury lamp. In some embodiments, light source 110 is a metal halide lamp. In certain embodiments, light source 110 is a sulfur lamp. In a number of embodiments, light source 110 is a laser, or a laser diode. In certain embodiments, light source 110 is a monochromatic light source. In a number of embodiments, light source 110 is a polychromatic light source. In a plurality of embodiments, light source 110 is a light source emitting light partially in the spectral range of ultraviolet light. In some embodiments, light source 110 is a device, product or a material emitting light partially in the spectral range of visible light. In a number of embodiments, light source 110 is a device, product or a material partially emanating or emitting light in the spectral range of the infra red light. In a number of embodiments, light source 110 is a device, product or a material emanating or emitting light in the visible spectral range. In some embodiments, light source 110 includes a filter to control the spectral range of the light emitted from the light source 110. In certain embodiments, light source 110 includes a light guide, an optical fiber or a waveguide through which light is emitted from the light source 110. In some embodiments, light source 110 includes one or more mirrors for reflecting or redirecting of light. In some embodiments, lighting device 110 reflects light emitted from another light source. In some embodiments, light source 110 includes a light reactive material affecting the light emitted, such as a polarizer, filter or a prism. In a plurality of embodiments, light source 110 is a coherent light source. In some embodiments, light source 110 is an incoherent light source.

In further details, the power 105 may be from any type and form of power source. The power supply may supply electrical power to the electrical load of the driver. The driver may be designed and constructed to be coupled, connect or receive power from the power supply 105. In some embodiments, the driver includes or incorporates the power supply. In some embodiments, the power supply may be a stand alone device. The power 105 may be AC or DC based. The power supply may be battery based. In some embodiments, a bridge rectifier is used to convert an AC signal input into a DC output signal. The DC output signal from the rectifier may be used as the power 105 providing the Vin to the driver. The DC output signal may be provides as input to the power source, such as a power regulator. The power supply may be regulated in that the output voltage and/or current is controlled or managed to a specific value or range.

The switch 120 may comprise any type and form of electrical component that can interrupt the current or divert the current from one conductor to another conductor. The switch may be electrically coupled to receive Vin or current from the power source 105. The switch may be electrically coupled to the hysteresis component to receive output from the hysteresis component as an input to the switch 120 to switch off and on. The frequency of switching between on and off may be driven or controlled by the hysteresis component. The switch may be electrically coupled to provide, when the switch is closed (On), current or Vin to the one or more light sources. When the switch is open (Off), the switch interrupts or diverts the current or Vin to the one or more light sources.

The switch may include or be electrically coupled in parallel to bypass circuitry, such as a pull-up or pull-down resistor, generally referred to herein as a bypass resistor. When the switch is open (off), the bypass resistor provides an input state to the circuitry connected to the light sources when no signal source, such as Vin, is connected. The bypass resistor prevents the voltage input from floating when the switch is open and Vin is not connected.

The output of the switch and/or bypass circuitry is electrically coupled to the one or more light sources. The output of the switch and/or bypass circuitry may be electrically coupled with a ballast 122 between the switch and light sources. The ballast may comprise an electrical component, such as a resistor, to limit the amount of current in the electrical circuit, such as current delivered or provided to the light sources. The ballast may be designed, constructed or configured to limit the current through the light sources to within a predetermined range or limit of the light sources, or otherwise to a desired level. The resistance value of the ballast resistor may be selected such that at the highest value of Vin, the current to the light sources when the switch is on is below the maximum rating of the light sources.

In some embodiments, an inductor 125 and diode 126 may be electrically coupled between the switch and/or bypass circuitry and/or the ballast and/or light sources. The inductor may comprise an electrical component to emphasize or filter certain frequencies of the signal, such as the output from the switch or bypass resistor. In some embodiments, the inductor may be used to filter out higher frequencies. In some embodiments, the inductor may be used to emphasize lower frequencies. The inductor may be designed and constructed to delay and reshape the signal (e.g., current), when current and/or voltage changes with time from the output of the switch and/or bypass circuitry. In some embodiments, any electrical circuitry providing a storage element or capacity may be included in the driver at the output of the switch. This may for example provide a buffer or otherwise implement a desired delay or signal shaping.

The light sources 110A-110N (generally referred herein as light source 110) may be electrically coupled between the switch and/or ballast and the measurement component 120. The light sources may each have a forward voltage Vf based on the material, design and construction of the light source. The Vf for each light source may change during operation of the light source, such as by changes in temperature, for example, heating and cooling. The Vf for each light source may be the same or different. The Vf for each light source may be within a predetermined range and/or in accordance with a forward voltage profile of the light source. The aggregate voltage drop across the light sources may be Vfa-n or the sum of Vfs of each light source.

The measurement component 130 may comprise any type and form of electrical circuitry or components to measure the voltage drop or Vfa-n across the light sources, such as via a current or voltage measurement. The measurement component may be electrically coupled to the one or more light sources. In some embodiments, the measurement component may be designed and constructed to measure the voltage output from or across the one or more light sources. In some embodiments, the measurement component may be designed and constructed to be a current measurement component to measure current outputted or passing through the one or more lights sources. In some embodiments, the current measurement component may convert the current measurement into a voltage. In some embodiments, the measurement component may comprise a resistor to sense the current passing through the light sources and converting the current into a voltage. The measurement component, such as a current sense resistor, may be electrically coupled to ground.

A filter 140 may be electrically coupled between the measurement component 120 and the hysteresis component 150. The filter may comprise any type and form of electrical circuitry or components to filter the measurement from the component measurement and providing a filtered version of this measurement to the hysteresis component. In some embodiments, the filter may comprise an RC (resistor-capacitor) circuit. RC circuits can be used to filter a signal by blocking certain frequencies and passing others, such as acting a high pass filter and/or low pass filter or band-pass filter. In some embodiments, the filter may comprise an RLC (resistor-inductor-capacitor) circuit. The capacitor of the filter may be selected or designed so that the oscillation frequency is slow enough not to overwork or overheat the switch but fast enough not to cause visible flashing to the naked eye. The filter may be designed and constructed to provide what may be referred to as a hysteresis band for driving the hysteresis component and the operation of the switch to operate within a band of certain frequencies.

The hysteresis component 150 may comprise any type and form of electrical circuitry or electrical components for controlling the switching of the switch based on a comparison between voltages in the electrical circuitry of the driver, such as the voltage input Vin and the measurement of Vfa-n from the measurement component. The hysteresis component may comprise an electrical comparator that compares two current or voltages and outputs the higher of the two. The hysteresis component may compare one input current or voltage to be above or below a threshold comprising a reference current or voltage. For example, the hysteresis component may compare the input voltage to a threshold comprising the variable voltage reference signal provided via the forward voltage Vfa-n.

In some embodiments, the hysteresis component comprises an op-amp comparator. In some embodiments, the hysteresis component comprises a voltage comparator chip. The output of the comparison may be electrically coupled to the switch to turn the switch on and off. The output of the comparison may be electrically coupled to an op-amp inverter, electrical buffer or gate electrically coupled to the switch.

The comparator of the hysteresis component may compare the voltage input, Vin, or a version of Vin, to the variable voltage measurement, or a version of the variable voltage measurement, from the forward voltage Vfa-n measured by the measurement component. The comparator of the hysteresis component may compare a version of the voltage input to a mixed signal, such as a combination of the variable voltage measurement with an output of the comparator through a feedback loop or circuitry.

As the hysteresis component receives and uses the variable voltage across the light sources, this provides historical input, data and measurements to provide a hysteresis based circuitry, control and driver. The variable voltage reference signal 115 will change over the course of operating and driving the light sources from a combination of changes to the voltage input and the changes in Vf of each of the light source responsive to the voltage input and the forward voltage profile of the light source.

As the hysteresis component receives and uses output of the comparator as a portion of input back into the comparator, this also provides another form of a hysteresis based circuitry, control and driver. The variable voltage reference signal 115 will further change over the course of operating the driver as the hysteresis circuitry will randomize the frequency of switching the switch on and the current drawn by the light sources. With the randomized frequency of how long the switch may be on (closed), the signal driving the light sources comprises a variable frequency on time with a constant off time signal 108. The design of the driver is configured to have times the switch is on vary based on changes to the input voltage. With the switch on time being at a randomized frequency and the resulting signal 108 having a variable frequency on time, the driver operates under and provides an automatic frequency spectrum 155. The frequency spectrum may comprise a range of different frequencies, such as within a band provided by the filter 140 and hysteresis component 150. The range of different frequencies are driven by the using the variable voltage reference signal 115 in combination with the filter and hysteresis component.

The driver 100 and/or hysteresis component may not use or incorporate a fixed voltage reference, such as zener diode which provides a fixed voltage over a wide range of currents. Instead of using a fixed voltage reference signal the driver and/or hysteresis component incorporates and uses the variable voltage output as a form of a hysteresis based reference for the comparator and to drive the switch.

The hysteresis component may include a mixer component to mix the signal received from the filter based on the measurement component with the output provided by the comparator or otherwise the hysteresis component. The mixer component may include a resistor electrically coupled between the filter and to one or more of: an input of the hysteresis component such as one of the inputs to a comparator and the output of the comparator such as via a feed forward resistor.

The hysteresis component may include a feedback loop electrically coupled between the output of the comparator and one of the inputs to the comparator. The feedback circuitry may include a resistor referred to as a feed forward resistor. The feedback circuitry may use the output of the comparator as part of the signal to an input of the comparator. The feedback circuitry may mix the signal from the output of the comparator with a version of the forward voltage measurement provided by the measurement component via the filter.

In some embodiments, the hysteresis component may receive the Vin signal or power from the power supply via a power supply compensator 107. The power supply compensator may comprise any type and form of electrical circuitry to provide a non-zero voltage input to the hysteresis component. The power supply compensator may comprise one or more resistors. The power supply compensator may be electrically coupled to ground.

In some embodiments of the design, construction or configuration of the driver circuitry, selected types and values of certain components may be used to facilitate, support or cause the desired operation and behavior of the driver. In some embodiments, the ballast resistor is selected to have a predetermined resistance so that, at the highest value of Vin, the current in the LEDs when the Switch is on is below the maximum rating of the LED. For example, this can be 10 to 30 Ohms typically, depending on LED current and Vin magnitude. In some embodiments, the capacitor of the filter is selected or configured to have a predetermined oscillation frequency that is below an operating or performance threshold of the switch, such slow enough to not overwork or overheat switch but fast enough to not cause visible flashing to the naked eye. For example, the capacitor can be 0.01 uF to 0.1 uF. In some embodiments, the capacitor and the design of the driver may be constructed or configured so that during a charging part of oscillation the filter reacts more quickly as the input voltage increases. In some embodiments, the capacitor and the design of the driver may be constructed or configured so that oscillation varies inversely with input voltage.

In some embodiments, the resistor of the filter may have a predetermined resistance, such as between 10 k to 50 k ohms. In some embodiments, the mixer filter may have a predetermined resistance that is the same as the filter resistor or may otherwise be in 10 k to 50 k ohms range. The resistance network of the power supply compensator may be designed and configured to have a predetermined resistance that creates a non-zero voltage at E. This can be 50 k and 5 k Ohms to ground or 10 k and 5 k Ohms to ground, depending on Vin magnitude. In some embodiments, the feed forward resistor is selected or configured to a predetermined resistance that causes it to have an effect much smaller than E but much larger than the offset voltage of the comparator. This may be in the 1 M Ohm range.

Figure 1B:
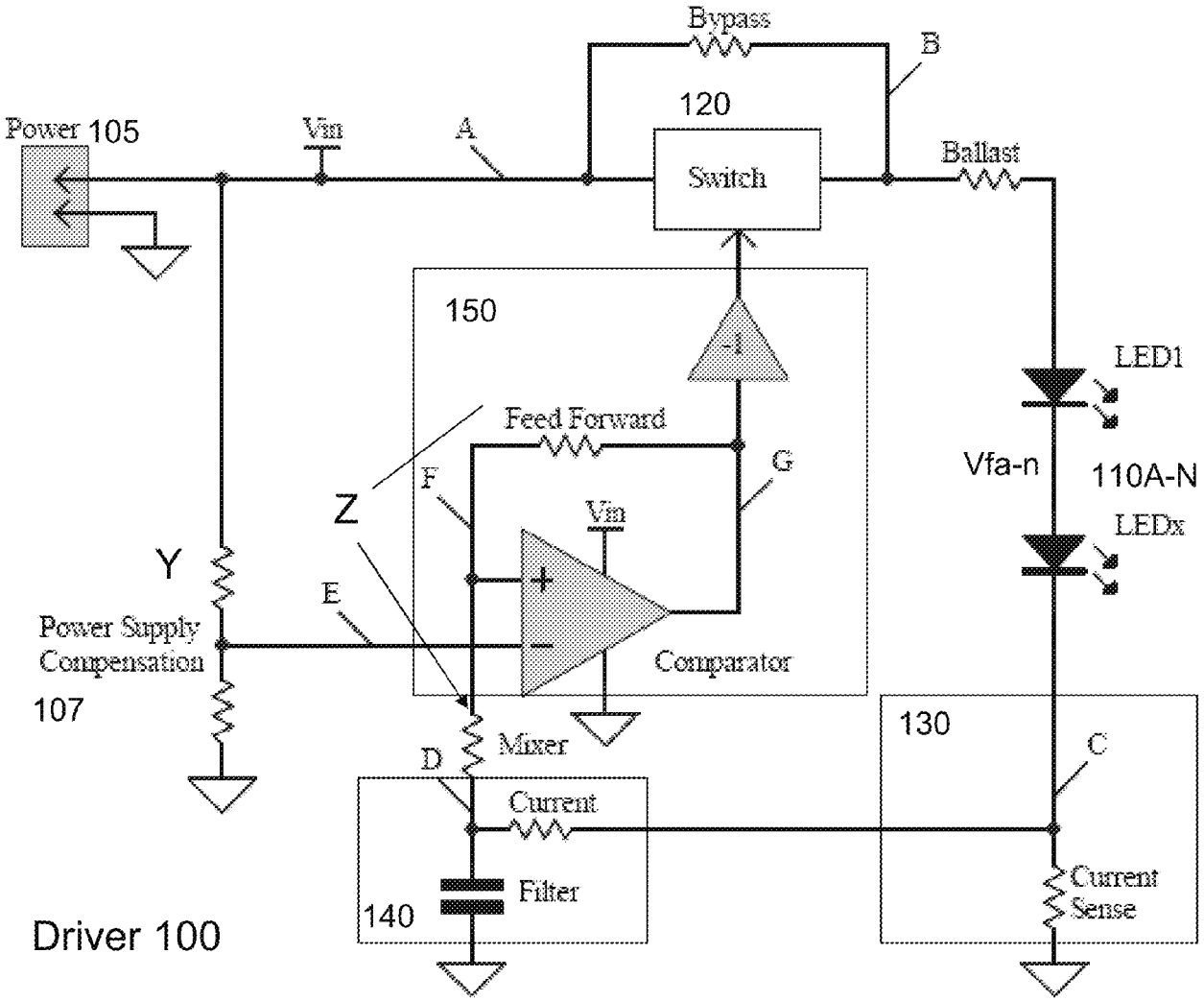
FIG. 1B is a block diagram that depicts another embodiment of the driver.

Referring now to FIG. 1B, is an embodiment of the circuitry of a driver 100. In brief overview, the driver may have an input coupled or connected to a power source 105 and ground. The power source 105 provides the Vin voltage input to the driver. The input from power supply 105 may be electrically coupled to a power supply compensator 107, which may include a series of one or more resistors electrically coupled to ground. The switch 120 includes a bypass resistor electrically coupled in parallel to the switch may received the Vin signal. The switch may be controlled or driven by a hysteresis component 150 comprising an op amp comparator comparing two voltage inputs and providing an output electrically connected to the switch, such as via an op amp invert or electrical bugger or gate. The hysteresis component includes a feed forward resistor electrically coupling the output of the comparator to an input of the comparator and electrically coupled to a mixed signal received via a mixer resistor. A second input of the comparator is electrically coupled to the signal provided via the power supply compensator 107. The hysteresis component is electrically coupled to the filter 140 comprising a capacitor and current resistor. The output of the filter 140 is electrically coupled to the hysteresis component 140 such as via the mixer resistor. The input of the filter 140 is electrically coupled to the measurement component 130, which comprises a current sense resistor electrically coupled to ground.

The light sources 110A-110N comprises LED1-LEDX electrically coupled between the measurement component 130 and the output of the switch and/or bypass resistor via a ballast resistor. The light sources 110A-110N comprise a voltage drop in the driver circuitry of a forward voltage of Vfa-n. The measurement component 130 measures the current passing through the light sources and provides this measurement signal to the filter 140, which in turn mixes the signal with the output of the comparator of the hysteresis component via the feed forward resistor. This mixed signal is provided as one voltage input to the comparator while the other voltage input to be compared is received from the power supply compensator. The output of the comparator is provided to the switch, such as via an inverter or buffer gate. The output of the comparator drives the switch on or off, which in turns either provides an off signal via the bypass resistor on an on signal via Vin. The signal 108 from the switch drives the one or more light sources, which in turn provides the forward voltage Vfa-n, which in turns provides the variable voltage reference to the hysteresis component. This variable voltage reference may be considered stable or fixed relative to the wide changes in the voltage supply or input voltage.

Based on the design and construction of the driver, the current change through the LEDs for a given input voltage change is larger than it would be without the forward voltage of the LEDs. This acts like negative feedback when the current is fed to the hysteresis component or the comparator. The voltage reference, for example at power supply compensator 107, acts like positive feedback to the hysteresis component or the comparator. When the negative and positive cancel out, there is regulation of the current.

Referring now to both FIG. 1B and FIG. 2, the details of operations of the driver will be discussed. As a point of reference in view of FIG. 1B, certain lettered reference points (A through G) or nodes are identified in the circuitry for purposes of discussion. Node A is the input voltage. Node B is the output of the switch, and voltage to LEDs. Node C is a measure of the current through the LEDs, converted to a voltage. Node D is a filtered version of the current measurement C. Node E is a scaled measure of the input voltage A. Node F is D combined with G. Node G is the result of a comparison of E and F.

Figure 2:
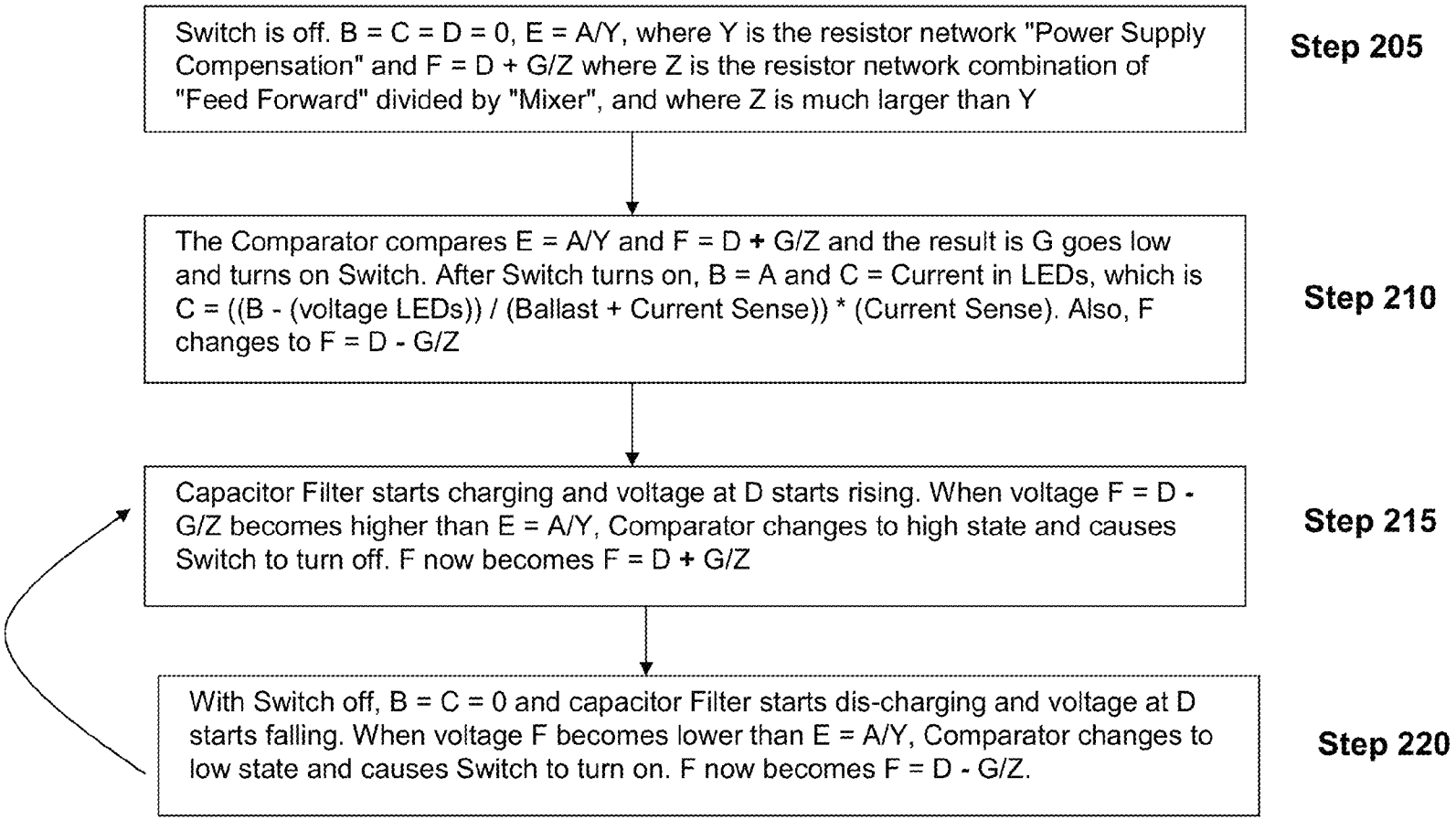
FIG. 2 is a flow diagram of an embodiment of a method of operation of the driver.

Referring to FIG. 2, an embodiment of a method of operation of the driver is illustrated. For purposes of discussion, the voltage input Vin is considered fixed, At step 205, the switch is an off state. At step 210, the hysteresis component compares the input voltages between nodes E and F and turns on the switch. At step 215, the filter start charging and the voltage at D rises. Responsive to the voltage at node F becoming higher than that he voltage at node E, the comparator turns the switch off. At step 220, the switch is off and the filter starts discharging and the voltage at node F starts to fall. Responsive to the voltage at node F become lower than the voltage at node E, the switch turns on. The driver continues to operate between steps 215 and 220 as the switch turns off and on and the capacitor charges and discharges.

In further details of step 205, initially, for example at time zero, the switch is off, which may be an initial default state. The voltage at each of nodes, B, C, and D is zero. The resistor network Y may comprises the resistance of and the resistors related to or making up the power supply compensator 107. The resistor network Z may comprise the resistors related to the feed forward resistor and the mixer resistor and which resistance may be equal to the feed forward resistance divided by the mixer resistance. The resistance network Z may be selected or configured to be much larger than the resistance network Y. Node E=A/Y while node F=D+G/Z.

At step 210, the comparator of the hysteresis component compares node E (A/Y) voltage to node F voltage (D+G/Z). Responsive to and as a result of the comparison, the output of the comparator, node G voltage, goes low and turns on the switch. Upon turning on the switch, node B voltage is equal to voltage at node A and node C is equal to the current in or passing through the LEDs. The voltage measurement at node C may be computed as follows:

$$C=((B-(\text{voltage LEDs}))/(\text{Ballast}+\text{Current Sense}))*(\text{Current Sense}).$$

As a result of the switch going on and the resulting electrical flow of voltage/current, the measurement at node F changes to F=D−G/Z.

At step 215, the capacitor in the filter starts charging. Responsive to the capacitor charging, the voltage at node D starts rising. As a result of node D voltage rising, the voltage at node F also rises. When voltage F=D−G/Z becomes higher than the voltage at node E=A/Y compared by the hysteresis component, the output of the hysteresis component changes to a high state. Response to the output at node G going high, the switch is turned off. As a result, the voltage at node F becomes F=D+G/Z At step 220, with the switch off, voltage at nodes B and C become zero. The capacitor of the Filter starts discharging and voltage at D starts falling. As a result, the voltage at node F starts falling as well. When voltage F becomes lower than E=A/Y, the output at Node G of the hysteresis component changes to low state and causes the switch to turn on. The resulting voltage at node F. The cycle repeats between steps 215 and step 220.

Current regulation occurs because the voltage at node C changes with a much larger effect than node A changes due to the presence of forward voltage Vfa-n of light sources in the equation for node C. Therefore, node D also changes with a much larger effect than node A. This causes the filter to react more quickly as the voltage at node A rises. However, this effect is only for the rising (charging) part of the oscillation. The falling (discharging) part of the oscillation always occurs at the same rate because it is only dependent on voltage E. The result is that the oscillation always has a near to constant off time, but on time varies inversely with voltage. This causes a large inverse effect which is partly compensated for by the change in voltage at node E and the change in voltage at node G.

What is claimed:

1. A driver for one or more light emitting diodes (LEDs) that incorporates forward voltage of the one or more LEDs to provide hysteresis, the driver comprising:

a first input to receive an input voltage;

a switch electrically coupled to the first input and electrically coupled to one or more light emitting diodes (LEDs), an output of the switch, when switched on, to provide voltage to the one or more LEDs;

a current measurement component electrically coupled to the one or more LEDS, to measure current through the one or more LEDs based on forward voltage of the one or more LEDs;

a hysteresis component comprising a comparator to receive as input the input voltage and a measurement of voltage based on the current measured by the current measurement component, wherein the hysteresis component comprises a feed forward resistor electrically coupled between a non-inverted input of the comparator and an output of the comparator, the non-inverted input of the comparator receiving the measurement of voltage based on the current;

wherein the current measurement component is configured to measure changes to the current based on changes to the forward voltage of the one or more LEDs; and wherein the hysteresis component is electrically coupled to the switch to turn the switch off and on responsive to changes to the input voltage in conjunction with the changes to the forward voltage of the one or more LEDs, as measured by the current measurement component, being above or below a threshold.

2. The driver of claim 1, further comprising a ballast resistor electrically coupled to the output of the switch, the ballast resistor comprising a predetermined resistance to provide a current, when the switch is on, to the one or more LEDs below the maximum rating of the one or more LEDs.

3. The driver of claim 1, wherein the comparator that compares the input voltage to the measurement of voltage based on the current measured by the current measurement component.

4. The driver of claim 3, wherein the feed forward resistor comprising a predetermined resistance that provides a smaller effect than the input voltage to the comparator and a larger effect than an offset voltage of the comparator.

5. The driver of claim 1, further comprising a filter electrically coupled between the current measurement component and the hysteresis component to provide a filtered version of the current measurement from the current measurement component as input to the hysteresis component, the filter configured to have a predetermined oscillation frequency to avoid exceeding a threshold of the switch.

6. The driver of claim 1, wherein the current measurement component includes a current sense resistor to convert into voltage the measurement of current through the one or more LEDs.

7. The driver of claim 1, wherein current to the one or more LEDs is regulated as the voltage output from the one or more LEDs changes with a lesser effect than changes to the input voltage.

* * * * *